US006754462B2

(12) United States Patent
Fujishiro

(10) Patent No.: US 6,754,462 B2
(45) Date of Patent: Jun. 22, 2004

(54) LATENT IMAGE CARRIER AND IMAGE FORMING APPARATUS HAVING A NOISE AND DEFORMATION PREVENTING MEMBER

(75) Inventor: Takatsugu Fujishiro, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 179 days.

(21) Appl. No.: 10/073,296

(22) Filed: Feb. 13, 2002

(65) Prior Publication Data

US 2002/0110387 A1 Aug. 15, 2002

(30) Foreign Application Priority Data

Feb. 13, 2001 (JP) ..... 2001-035146

(51) Int. Cl.[7] ..... G03G 15/00
(52) U.S. Cl. ..... 399/159
(58) Field of Search ..... 399/116, 117, 399/159, 167, 91

(56) References Cited

U.S. PATENT DOCUMENTS

| | | | |
|---|---|---|---|
| 4,659,206 A | 4/1987 | Kai et al. | |
| 5,339,141 A | 8/1994 | Suzuki et al. | |
| 5,424,814 A | 6/1995 | Suzuki et al. | |

(List continued on next page.)

FOREIGN PATENT DOCUMENTS

| | | | |
|---|---|---|---|
| EP | 0 698 828 | 2/1996 | |
| GB | 1 457 776 | 12/1976 | |
| JP | 58-86585 | 5/1983 | |
| JP | 60247280 A | * 12/1985 | ..... G03G/21/00 |
| JP | 61210384 | * 9/1986 | ..... G03G/21/00 |
| JP | 63008684 A | * 1/1988 | ..... G03G/21/00 |
| JP | 03105348 A | * 5/1991 | ..... G03G/5/10 |
| JP | 4-69383 | 11/1992 | |
| JP | 05281773 A | * 10/1993 | ..... G03G/5/10 |
| JP | 08202204 A | * 8/1996 | ..... G03G/21/00 |
| JP | 10-333499 | 12/1998 | |

OTHER PUBLICATIONS

U.S. patent application Ser. No. 10/456,583, Fujishiro et al., filed Jun. 9, 2003.
U.S. patent application Ser. No. 10/382,888, Nakahara, filed Mar. 7, 2003.
U.S. patent application Ser. No. 10/320,399, Shinohara, filed Dec. 17, 2002.
U.S. patent application Ser. No. 09/408,433, filed Sep. 29, 1999, Unknown.
U.S. patent application Ser. No. 10/329,371, Ehara et al., filed Dec. 27, 2002.
U.S. patent application Ser. No. 09/925,657, filed Aug. 10, 2001, pending.
U.S. patent application Ser. No. 09/930,439, filed Aug. 16, 2001, pending.

(List continued on next page.)

*Primary Examiner*—Robert Beatty
(74) *Attorney, Agent, or Firm*—Oblon, Spivak, McClelland, Maier & Neustadt, P.C.

(57) ABSTRACT

Disclosed is a latent image carrier provided with a structure in which noise generation can be prevented and an opposing gap between a charging device and the latent image carrier is prevented from being altered as well, whereby change in charging property is not generated and the formation of an abnormal image can be prevented in the case where a thin cylindrical body is employed as the latent image carrier. The latent image carrier is capable of forming an electrostatic latent image which corresponds to an image by means of optical writing after which a photosensitive layer has been uniformly charged. The latent image carrier is characterized in that the latent image carrier is formed of a thin cylindrical body and deformation preventing member is disposed in an interior portion thereof along the circumferential and axial directions.

7 Claims, 6 Drawing Sheets

U.S. PATENT DOCUMENTS

| | | | | | |
|---|---|---|---|---|---|
| 5,430,526 | A | * | 7/1995 | Ohkubo et al. | 399/159 |
| 5,440,373 | A | | 8/1995 | Deki et al. | |
| 5,512,984 | A | | 4/1996 | Kimura et al. | |
| 5,515,145 | A | | 5/1996 | Sasaki et al. | |
| 5,537,197 | A | | 7/1996 | Fujishiro et al. | |
| 5,565,973 | A | | 10/1996 | Fujishiro et al. | |
| 5,583,630 | A | | 12/1996 | Kimura et al. | |
| 5,621,221 | A | | 4/1997 | Shinohara et al. | |
| 5,655,193 | A | | 8/1997 | Fujishiro et al. | |
| 5,671,465 | A | | 9/1997 | Kimura et al. | |
| 5,722,016 | A | * | 2/1998 | Godlove et al. | 399/159 |
| 5,737,665 | A | | 4/1998 | Sugiyama et al. | |
| 5,765,083 | A | | 6/1998 | Shinohara | |
| 5,875,380 | A | | 2/1999 | Iwata et al. | |
| 5,899,597 | A | | 5/1999 | Shinohara et al. | |
| 5,953,568 | A | | 9/1999 | Fujishiro et al. | |
| 5,962,783 | A | | 10/1999 | Iwata et al. | |
| 5,963,240 | A | | 10/1999 | Shinohara et al. | |
| 6,070,030 | A | | 5/2000 | Fujishiro | |
| 6,075,955 | A | | 6/2000 | Cais et al. | |
| 6,118,557 | A | | 9/2000 | Sugiyama et al. | |
| 6,122,468 | A | | 9/2000 | Sakamoto et al. | |
| 6,128,459 | A | | 10/2000 | Iwata et al. | |
| 6,205,308 | B1 | * | 3/2001 | Tanaka et al. | 399/159 |
| 6,249,304 | B1 | | 6/2001 | Sawayama et al. | |
| 6,282,396 | B1 | | 8/2001 | Iwata et al. | |
| 6,295,435 | B1 | | 9/2001 | Shinohara et al. | |
| 6,295,438 | B1 | | 9/2001 | Fujishiro et al. | |
| 6,308,027 | B1 | | 10/2001 | Obu et al. | |
| 6,380,960 | B1 | | 4/2002 | Shinohara | |
| 6,381,435 | B2 | | 4/2002 | Shinohara et al. | |
| 6,470,158 | B2 | * | 10/2002 | Fritz et al. | 399/91 |

OTHER PUBLICATIONS

U.S. patent application Ser. No. 10/041,648, filed Jan. 10, 2002 pending.
U.S. patent application Ser. No. 10/041,640, filed Jan. 10, 2002, pending.
U.S. patent application Ser. No. 10/247,699, filed Sep. 20, 2002, pending.
U.S. patent application Ser. No. 10/243,933, filed Sep. 16, 2002, .
U.S. patent application Ser. No. 09/810,565, Mar. 19, 2001, allowed.
U.S. patent application Ser. No. 09/785,234, filed Feb. 2, 2001, pending.
U.S. patent application Ser. No. 09/862,580, filed Sep. 26, 2001, pending.
U.S. patent application Ser. No. 09/964,584, Sep. 28, 2001, pending.
U.S. patent application Ser. No. 09/978,097, filed Oct. 17, 2001, pending.
U.S. patent application Ser. No. 09/985,368, filed Nov. 2, 2001, allowed.
U.S. patent application Ser. No. 09/987,027, filed Nov. 13, 2001, pending.
U.S. patent application Ser. No. 10/073,237, Feb. 13, 2002, pending.
U.S. patent application Ser. No. 10/073,296, filed Feb. 13, 2002, pending.
U.S. patent application Ser. No. 10/101,994, Mar. 21, 2002, pending.
U.S. patent application Ser. No. 10/231,281, filed Aug. 30, 2002, pending.
U.S. patent application Ser. No. 09/758,192, filed Jan. 12, 2001, pending.
U.S. patent application Ser. No. 09/778,738, filed Feb. 8, 2001, pending.
U.S. patent application Ser. No. 09/826,813, filed Apr. 6, 2001, allowed.
U.S. patent application Ser. No. 09/960,354, filed Sep. 24, 2001, pending.
U.S. patent application Ser. No. 09/962,899, filed Sep. 26, 2001, pending.
U.S. patent application Ser. No. 10/145,899, filed May 16, 2002, pending.
U.S. patent application Ser. No. 09/848,320, filed May 4, 2001, pending.
U.S. patent application Ser. No. 09/910,080, filed Jul. 23, 2001, pending.

* cited by examiner

LATENT IMAGE CARRIER AND IMAGE FORMING APPARATUS HAVING A NOISE AND DEFORMATION PREVENTING MEMBER

BACKGROUND OF THE INVENTION

1. Field of the Invention

The present invention relates to a latent image carrier and an image forming apparatus for employing the latent image carrier; and more particularly to the image forming apparatus having a noise prevention structure in a photorecepter serving as the latent image carrier.

2. Description of the Prior Art

In image forming apparatuses, such as a copier, a facsimile, and a printer, an unfixed image transferred and carried on a recording medium such as a sheet of paper is fixed thereon and formed into a copied object or a printed output.

Charging process is one of the image forming processes that is conducted in an image forming apparatus.

The process is a process of charging a uniform electric charge to a photoreceptor serving as a latent image carrier. However, as the charging method, there is charge or contact charge by corona discharge. Corona discharge is a method in which a corona charger, which is disposed so that a predetermined gap is provided between the photoreceptor and the corona charger; is arranged and a high voltage is applied to a charger wire to thereby perform corona discharge. According to this method, discharged products such as ozone and nitrogen oxide are generated during discharge. As such products bring about environmental deterioration, recently, a contact charge method that can be charged with a low voltage and not generate the above-mentioned drawbacks is being adopted.

According to the contact charging method, a conductive roller, brush, or blade is made to come into contact with the photoreceptor and a voltage is applied therebetween, whereby charge injection can be performed on the photoreceptor.

In the case of the contact charging method, the application of a low voltage is fine and there is no generation of discharge products. However, deposition such as residual toner or the like on the photoreceptor are apt to be reversibly transferred since the charger is in direct contact with the photoreceptor. Moreover, when left unattended for a long period of time, a permanent bend will occur to a portion of the charger member in contact with the photoreceptor causing it to deform. Thus, when the charge process is conducted once more, there may be a change in the status of contact with the photoreceptor. Consequently, there was fear that failure to uniformly contact the photoreceptor will lead to inconsistent charging.

In order to resolve the drawbacks in the above-mentioned contact charging method, a method in which a predetermined microscopic interval is maintained between the photoreceptor and the charging member, what is known as a method of forming a noncontact state charging range between the photoreceptor and the charging member has been proposed. Of the structures employed in this method, there is one in which when a roller is used as the charging member, for instance, a film having a predetermined thickness is wrapped around both of the axial circumferential surfaces of the charging roller, whereby a gap of the microscopic interval can be provided by the thickness of the film.

Maintaining the aforementioned gap of the microscopic interval according to predetermined dimensions is critical to not changing the charging property, In other words, on the assumption that the gap is being maintained, uniform charging can be performed by applying a DC voltage relatively easy to set. However, when there is a change in the size of the gap making it larger than the predetermined gap, a charged potential will change in response to the increasing change thereof. Hence, in the prior art, superimposing AC voltage on the DC voltage is conducted so that a uniform charging property may be attained even if a change in the size of the gap occurs.

A core bar of a relatively light material having conductivity is employed as a structure of the photoreceptor. Specifically, a thinly formed cylinder made of aluminum is used.

There are cases in which noise is generated during an operation in a photoreceptor of such structure. In other words, devices for performing each of the processes of charging, writing, developing, transferring, and cleaning are arranged facing the photoreceptor.

Among these devices, particularly, the charging device and the cleaning device are often the source of generating noise in the photoreceptor.

As is apparent from the aforementioned charging condition, since an AC voltage superimposed on a DC voltage is applied to the charging device, the thin cylindrical part will easily resonate when the AC voltage is applied. The resonance of the thin cylindrical part is the cause of conveying noise to the periphery parts.

A blade in contact with the photoreceptor is provided in the cleaning device. Owing to the repetitious movement of the blade being dragged along with the movement of the photoreceptor and then returning back to its original position, the thin cylindrical part vibrates, causing the photoreceptor to resonate and generate noise.

On the other hand, though a gap of a microscopic interval is formed in the charging device which faces the photoreceptor as in the above structure, when a deformation occurs in the photoreceptor side, that is, if a portion of the circumferential wall thereof dents or swells, the microscopic interval will be altered even if the microscopic interval is maintained on the side of the charging device, thus leading to a change in the charging property. A change in the charging property causes the formation of an abnormal image.

SUMMARY OF THE INVENTION

The present invention has been made in view of the foregoing problems in a conventional latent image carrier and image forming apparatus employing the conventional latent image carrier, and therefore has an object to provide a latent image carrier and an image forming apparatus equipped with a structure capable of preventing noise generation and alteration of a gap formed between the latent image carrier and a charging device opposite each other to prevent a change in a charging property thereof from occurring, whereby the prevention of generating an abnormal image can be made in the case where a thin cylindrical body is utilized as the latent image carrier.

To achieve the above object, according to a first feature of the present invention, there is provided a latent image carrier capable of forming an electrostatic latent image which corresponds to an image by means of optical writing after which a photosensitive layer has been uniformly charged, characterized in that the latent image carrier is formed of a thin cylindrical body and deformation preventing member is disposed in the interior portion thereof along the circumferential and axial directions.

According to a second feature of the present invention, the aforementioned deformation preventing member is characterized in that it comprises a base positioned at a shaft of the latent image carrier and at plural places of the base, a plurality of leg parts extending therefrom along the circumferential direction of the latent image carrier with their distal ends elongated towards the interior of the latent image carrier is provided with a bulging portion capable of coming into contact with the inside surface of the latent image carrier.

According to a third feature of the present invention, the aforementioned deformation preventing member is characterized in that it is twisted in the axial direction of the latent image carrier forming successive blade structures from one axial end thereof towards the other axial end thereof.

According to fourth and fifth features of the present invention, the aforementioned deformation preventing member is characterized in that it is formed of an elastic body. In this case, a diameter of said deformation preventing member is greater than an inner diameter of said latent image carrier upon non-elastic deformation of the deformation preventing member.

A fifth feature of the present invention is characterized in that rubber is used as the aforementioned deformation preventing member, A sixth feature of the present invention is characterized in that the latent image carrier is formed of a rigid body.

According to a seventh feature of the present invention, rubber is used as the deformation preventing member.

According to an eighth feature of the present invention, an Image forming apparatus uses the latent image carrier which has the aforementioned features.

BRIEF DESCRIPTION OF THE DRAWINGS

The above and the other objects, features and advantages of the present invention will be more apparent from the following description made in connection with the accompanying drawings in which.

DETAILED DESCRIPTION OF THE PREFERRED EMBODIMENTS

Figure 1:
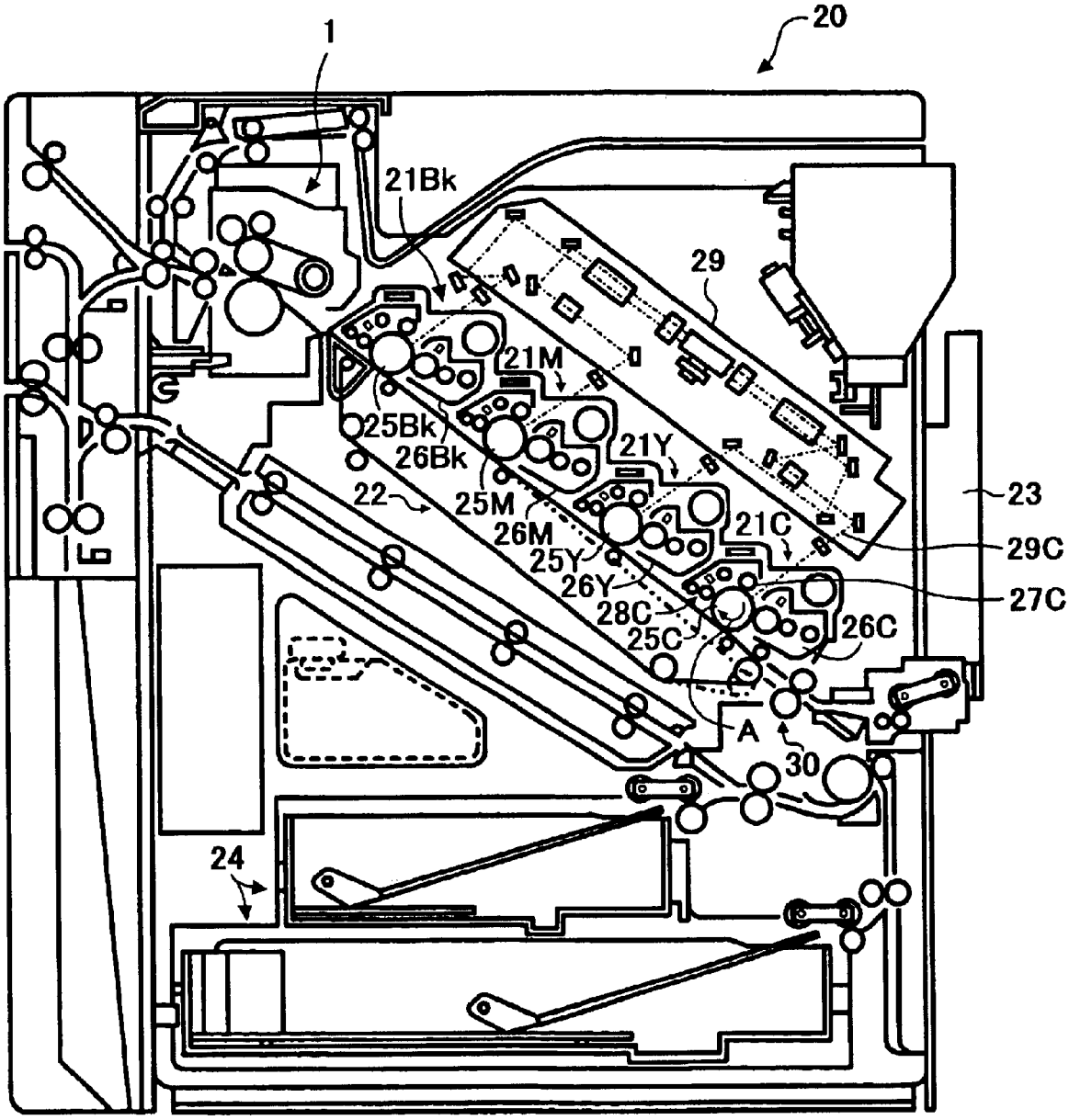
FIG. 1 is a schematic view for explaining an example of an image forming apparatus to which a latent image carrier is applied according to one embodiment of the present invention.

Referring to FIG. 1, an image forming apparatuses having a fixing unit applied thereto according to the present invention. A copier or a printer capable of forming full color images is used as the image forming apparatus shown in this drawing. Similar to the above-mentioned copier or printer, a facsimile, another form of the image forming apparatus, is capable of performing image forming process based on the image signals it receives. Note that the image forming apparatus is not only intended for forming the above-mentioned color images, but apparatuses for forming single color images are also included, of course.

A method of sequentially transferring each color separation of an image to a same intermediate transfer body and then collectively transferring the image superimposed on the intermediate transfer body to a sheet-like recording medium such as paper is employed in an image forming apparatus 20 shown in FIG. 1.

Referring to FIG. 1, the image forming apparatus 20 comprises each of the devices cited in the following.

The devices include image forming devices 21C, 21Y, 21M, and 21BK for forming each of the colors of an image corresponding to an original image, a transfer device 22 arranged opposite each of the image forming devices 21C, 21Y, 21M, and 21BK, manual feeding tray 23 and paper feed cassettes 24, 24 serving as a sheet-like medium supplying means for supplying every kind of sheet-like medium to a transfer region where the image forming devices 21C, 21Y, 21M, and 21BK and the transfer device 22 face each other, a resist roller 30 for supplying the sheet-like medium conveyed from the manual feeding tray 23 and paper feed cassettes 24, 24 in accordance with the timing of image-forming by the image forming devices 21C, 21Y, 21M, and 21BK and a forming device 1 disposed in the transfer region for fixing an image on the sheet-like medium after the image has been transferred thereon.

It is possible to use normal paper generally used in a copier or the like (hereinafter, simply referred to as normal paper) and special sheets having a thermal capacity larger than that of normal paper including OHP sheets, 90K papers such as cards and post cards, thick papers having a basis weight of about 100 g/m$^2$ or more, envelopes or the like as the sheet-like medium of the image forming apparatus 20, Each of the image forming devices 21C, 21Y 21M, and 21BK develops each of the colors cyan, yellow, magenta, and black, respectively. Though the color of the toner employed is different, the structures thereof are the same. Therefore the structure of the image forming device 21C will be described typifying the respective image forming devices 21C, 21Y, 21M, and 21BK.

A well-known structure of an electrostatic latent image carrier comprising: a photoreceptor drum 25C, which is constructed of a thin cylindrical body having an outside diameter of 30 mm, an inside diameter of 27.5 mm, and a circumferential wall of 0.75 mm thick; a charging device 27C, a developing device 26C, and a cleaning device 28C arranged sequentially along the rotating direction A of the photosensitive body drum 25C; and an exposed light 29C received between the charging device 27C and the developing device 26C is employed as the electrostatic latent image carrier of the image forming device 21C. In the image forming apparatus 20 shown in FIG. 1, the transfer device 22 is disposed extendedly in an inclined manner, and hence the space occupied by the transfer device 22 at a horizontal position can be lessened.

Figure 2:
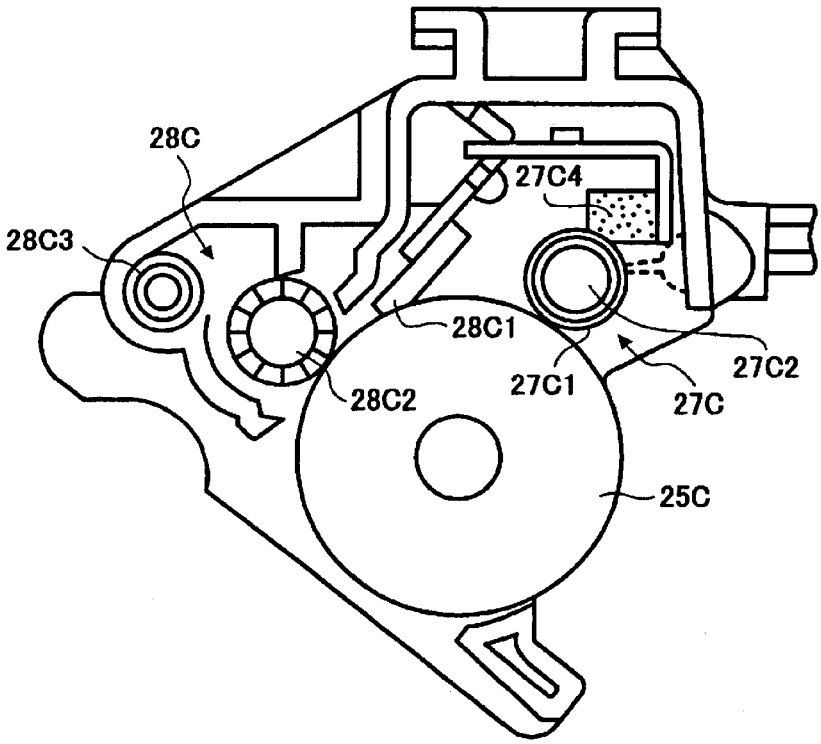
FIG. 2 is a schematic view illustrating an image forming device unit in the image forming apparatus shown in FIG. 1.

Each of the respective image forming devices 21C, 21Y, 21M, and 21BK are structured as unit components as shown in FIG. 2 and incorporated in the image forming apparatus 20.

Referring to FIG. 2, the photoreceptor drum (for the sake of convenience, explanations will be made on the image forming device 21C as the subject matter, and therefore is denoted by reference numeral 25C in relation thereto), the charging device 27C, and the cleaning device 28C are arranged in the image forming device unit.

As shown in FIG. 8, a roller-shaped core bar is used as the charging device 27C and, in the axial direction thereof, the circumferential surface near both endmost parts is wrapped with a film 27C1 which has a thickness for maintaining a predetermined fine gap between the photoreceptor drum 25C and the charging device 27C. The charging device 27C is pressured and urged towards the photoreceptor drum 25C by a spring 27C3 provided on a rotary axis 27C2, and the film 27C1 comes in contact with the circumferential surface of the photoreceptor drum 25C to thereby set an opening G therebetween facing each other. For example, DC-700V is applied to the core bar by means of a constant voltage control and AC voltage is applied thereto as well, whereby the charging device 27C uniformly charges the photoreceptor drum 25C via the aforementioned opening G by means of air discharging.

Shown in FIG. 2 is the cleaning device 28C in contact with the photoreceptor drum 25C and comprising a cleaning blade 28C1 for scraping off residual toner, a brush 28C2 for collecting the toner scraped off by the cleaning blade 28C1, and a disposed toner conveying means 28C3 made of a screw auger for conveying the toner collected by the brush 28C2 towards a disposed toner accommodating portion.

Regarding a cleaning mechanism, it is also provided in the charging device 27C. A pad member 27C4 in contact with the film 27C1, which is wrapped around both axial ends of the core bar, is employed as the cleaning mechanism of the charging device 27C. The provision of a cleaning mechanism in the charging device 27C is that as long as the film 27C1 is constantly in contact with the photorecepter drum 25C, the pad member 27C4 is a member for preventing toner or the like adhered to the photoreceptor drum 25C from being transferred back to the film. Changes in the contact state between the film 27C1 and the photoreceptor drum 25C due to the reverse transfer of toner or dust is prevented so that the opposing gap between the photoreceptor drum 25C and the charging device 27C is always maintained uniformly.

A structure for preventing the generation of noise is provided in the photoreceptor drum 25C.

Figure 4:
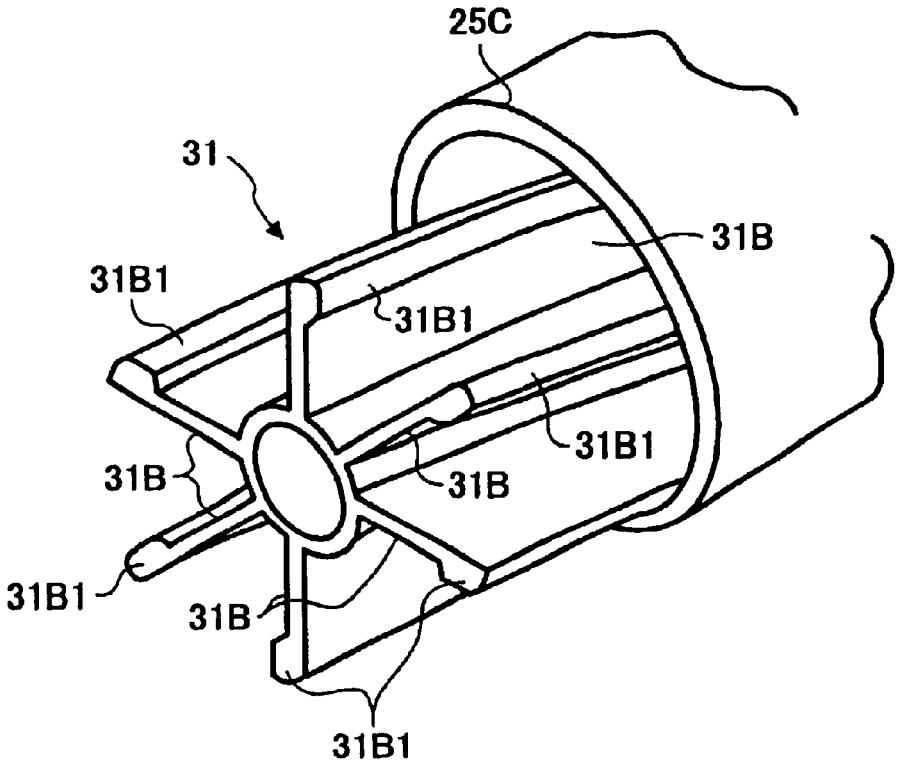
FIG. 4 is a perspective view showing a portion of a structure of a latent image carrier applied to the image forming apparatus shown in FIG. 1.

The photoreceptor drum 25C shown in FIG. 4 is formed thin, that is, having a circumferential wall of 0.75 mm thick, and deformation preventing member 31 is loaded in a space portion in the interior part thereof Placed in the interior part of the photoreceptor drum 25C, the deformation preventing member 31 provided with a base 31A that is positioned in the center of the photoreceptor drum 25C, is a press-touchable member formed on the interior surface of the circumferential wall of thee photoreceptor drum 25C along the circumferential and axial direction thereof.

The base 31A has a plurality of leg parts 31B in a circumferential direction and which are elongated radially. The plurality of leg parts 31B are formed of elastic bodies deformable in a bending manner when press-touched to the inner surface of the circumferential wall of the photoreceptor drum 25C. In the present embodiment, EP rubber is used to form the leg parts 31B integrally formed with the base 31A.

The base 31A is formed of a hollow cylinder and along the circumferential direction at several places thereof, the leg parts 31B are integrated thereto.

Figure 5A:
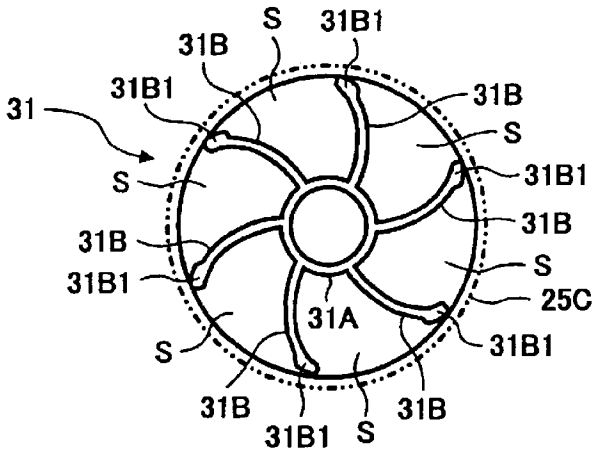
FIGS. 5A and 5B are a side view and a front view, respectively, showing deformation preventing member loaded in the interior portion of the latent image carrier shown in FIG. 4.

FIG. 5 is a drawing illustrating the details of the deformation preventing member 31. In FIG. 5A, the extended length of the leg parts 31B is larger than the inside diameter of the photoreceptor drum 25C, and is thus formed of blade structures elongated in the radial direction from the base 31A. Bulging portions 31B1 formed of thick portions protruding in the circumferential direction are provided at the distal end of the leg parts 31B.

The bulging portions 31B1 have areas that may come in contact with the interior surface of the circumferential wall of the photoreceptor drum 25C when the leg parts 31B deform in a bending manner.

The deformation preventing member 31 can be bent circumferentially when inserted into the photoreceptor drum 25C due to a difference formed between the extension length of the leg parts 31B and the inside diameter of the photoreceptor drum 25C, and the bulging portion 31B1 can be press-touched to the interior surface of the circumferential wall of the photoreceptor drum 25C owing to elasticity resilience.

Figure 5B:
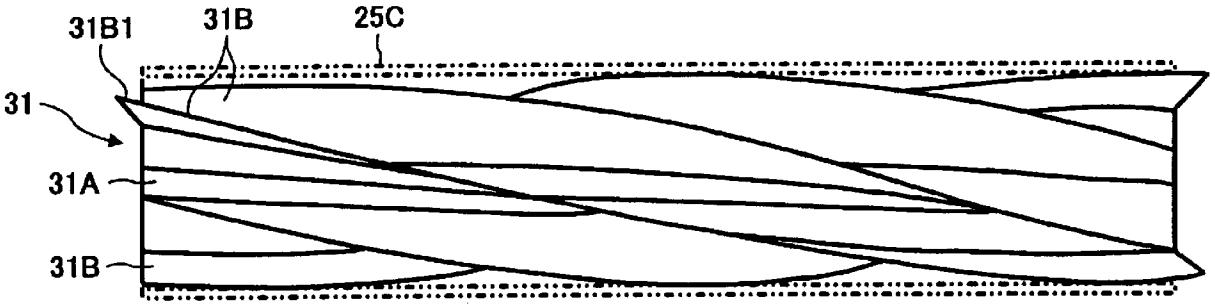

As shown in FIG. 5B, the leg parts 31B are successively twisted in the axial direction from one end thereof towards the other end thereof. When inserting the leg parts 31B into the photoreceptor drum 25C, the direction in which the leg parts 31B are to be twisted is set to a toppling direction of the leg parts 31B to thereby attain a direction in which the bulging portions 31B1 are press-touched to the interior surface of the circumferential wall of the photoreceptor drum 25C.

The present embodiment is thus composed as such wherein the deformation preventing member 31 is inserted inside the photoreceptor drum 25C and incorporated therein.

The incorporation of the deformation preventing member 31 is performed by inserting the deformation preventing member 31 into the photoreceptor drum 25C from one axial end thereof. When the deformation preventing member 31 is inserted into the photoreceptor drum 25C, it is subjected to insertion resistance and can move in a rotating manner in the twisting direction.

Upon being subjected to insertion resistance due to the rotating twist operation, the bulging portions 31B1 topples in the direction of coming into contact with the interior surface of the circumferential wall. Utilizing the elasticity resilience of the leg parts 31B, the bulging portions 31B1 are press-touched to the interior surface of the circumferential wall. Accordingly, the leg parts 31B bear the role of a pole press-touched to the interior surface of the circumferential wall of the photoreceptor drum 25C, whereby the circumferential wall is suppressed from deforming and a vibration-control function can be demonstrated.

Figure 3:
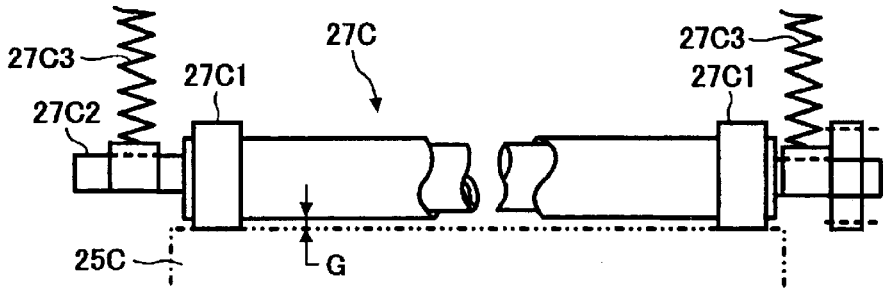
FIG. 3 is a front view for explaining the structure of a charging device applied to the image forming device unit shown in FIG. 2.
Figure 6:
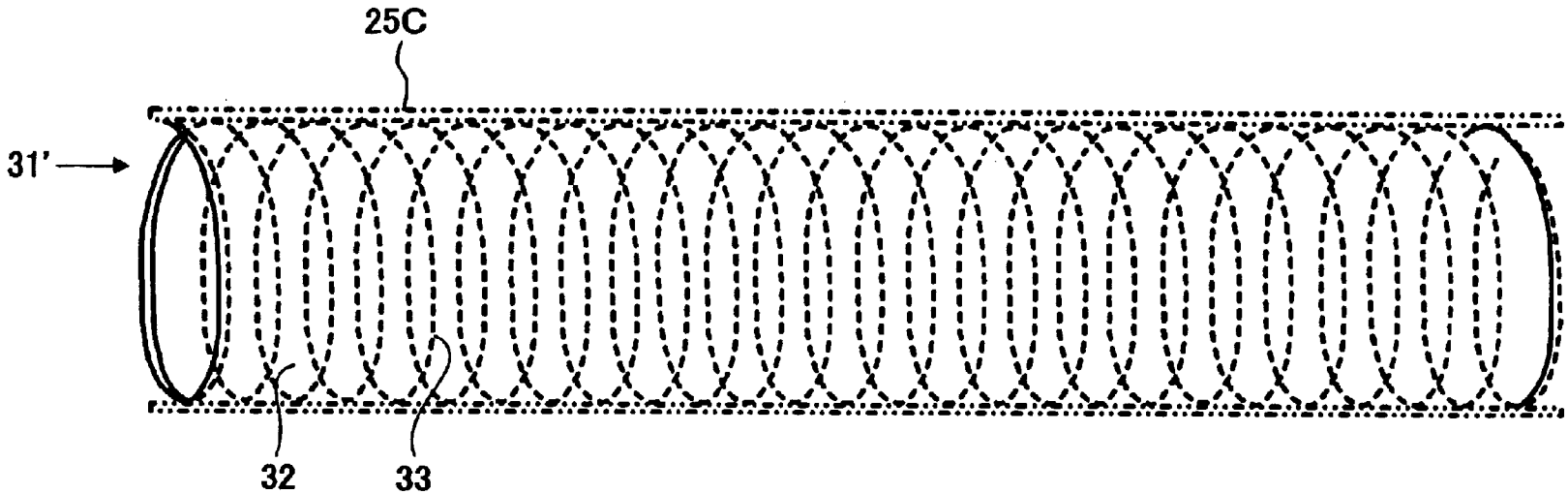
FIG. 6 is a front view showing a different example of the deformation preventing member shown in FIGS. 5A and 5B.
Figure 7A:
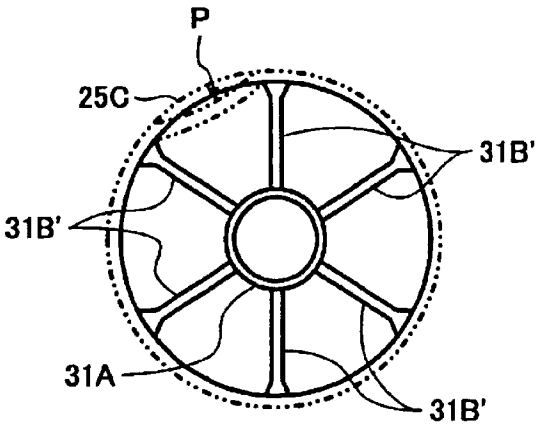
FIGS. 7A and 7B are a side view and a front view, respectively, of a false structure for explaining an operation by the deformation preventing member shown in FIGS. 5A and 5B.
Figure 7B:
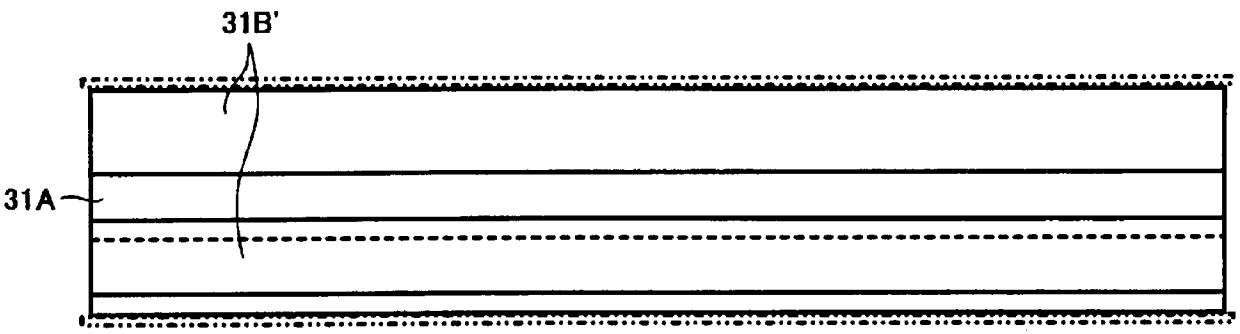

The distal end of the leg parts of the deformation preventing member 31, that is, the bulging portions 31B1 thereof, are press-touched to the interior surface of the circumferential wall of the photoreceptor drum 25C in the circumferential and axial direction and thus can be made to function as strengthening parts for the circumferential wall. The spring modulus of the circumferential wall is increased, whereby the vibration-control function can be attained. Besides, the bulging portions 31B1 are press-touched to the circumferential wall of the photoreceptor drum 25C in the circumferential and axial direction thereof, and therefore spaces between adjacent leg parts 31B in the circumferential direction, that is, spaces denoted reference symbol S in FIG. 5A are sealed spaces formed by the base 31A and the leg parts 31B. The rigidity in the special section is enhanced whereby deformation of the circumferential wall is suppressed. Consequently, the gap (denoted by reference symbol G in FIG. 3) between the circumferential surface of the photoreceptor drum 25C and the charging device 27C can be prevented beforehand from becoming deformed when a deformation in the circumferential wall occurs. As shown in FIG. 7, this is, for example, as in the case where the leg parts 31B are extended linearly in the radial and axial direction of the circumferential direction of the photoreceptor drum 25C and no space is formed between the adjacent leg parts 31B. This implies that the circumferential wall between adjacent leg parts 31B in the circumferential direction of the photoreceptor drum 25C (state denoted by the two-dot chain line P in FIG. 6) will never deform.

According to the present embodiment, the leg parts 31B are formed twisted in the axial direction, whereby a state in which the bulging portions 31B1 are automatically press-touched to the interior surface of the circumferential wall by an insertion operation can be attained. The leg parts 31B can thus be made to function as the strengthening parts press-touched to the interior surface of the circumferential wall of the photoreceptor drum 25C without the need to perform a special rotating operation or the like.

It is to be noted that as a structure wherein leg parts are in a twisted state in the axial direction of the photoreceptor drum 25C, there is a coil. In this case, as shown in FIG. 6, a structure in which a coil 33 and an elastic cylindrical body 32 that can be coupled to the expansion movement of the coil 33 disposed on the outer circumference thereof is employed as the deformation preventing member (for the sake of convenience, denoted by reference numeral 31'). In this structure, the coil 33 twisted so that the diameter thereof is contracted is inserted into the photoreceptor drum 25C in this state. Then the coil 33 returns back to its original shape so that a state wherein the coil 33 is press-touched to the interior surface of the circumferential wall of the photoreceptor drum 25C is formed, whereby the elastic cylindrical body 32 can be press-touched to the interior surface of the circumferential wall in circumferential and axial direction. As a result, it is possible to suppress the circumferential wall in the circumferential and axial direction from deforming. Further, the bulging portion 31B1 is formed not only as the convex portion capable of contacting the interior surface of the photoreceptor drum 25C, but it is also possible to form a plurality of convex portions on the leg parts 31B so that at least one of the convex portions may come in contact with the interior surface of the circumferential wall of the photoreceptor drum 25C in spite of the bending state of the leg parts 31B.

According to the first and second features of the present invention, due to the provision of the deformation preventing member along the circumferential and axial directions of the latent image carrier formed of a thin cylindrical body, the spring modulus of the circumferential wall is increased, whereby resonance is suppressed. Particularly, according to the second aspect of the present invention, since the plurality of leg parts extending from the base, which is positioned at the shaft of the latent image carrier, with their distal ends elongated towards the interior of the latent image carrier and having bulging portions at the distal ends capable of coming into contact with the inside surface of the latent image carrier is provided, the leg parts can be press-touched along the circumferential and axial direction of the latent image carrier, thus making it possible to suppress the circumferential wall of the latent image carrier from deforming while it resonates, thereby restraining the circumferential wall from vibrating. Consequently, the latent image carrier will not resonate during the application of the AC voltage to the charging device, in addition to the DC voltage, and furthermore, the vibration of the cleaning blade will not be conveyed. Therefore, generation of noise may be suppressed.

According to the third feature of the present invention, the deformation preventing member is composed of successive blade structures twisted in the axial direction of the latent image carrier from one axial end thereof towards the other axial end thereof, and therefore is press-touched to the entire region of the circumferential direction of the latent image carrier. Thus, the vibration of the circumferential wall can be suppressed and unlike the blade structure extended only in the radial direction, resonance of the circumferential wall in the circumferential direction can be positively suppressed. In addition, because the deformation preventing member is twisted in the axial direction, the act of rotating and contacting the latent image carrier in the axial direction can be performed simultaneously when inserting the deformation preventing member therein, and hence insertion can be performed smoothly unlike an insertion by pressing only.

According to the fourth and the fifth features of the present invention, it is possible to efficiently repress resonance and prevent noise generation since the deformation preventing member is an elastic body, especially formed of rubber, and therefore can absorb the resonance of the circumferential wall due to elastic deformation. The deformation preventing member can firmly be inserted into the latent image carrier since a diameter of the deformation preventing member is greater than an inner diameter of the latent image carrier.

According to the eighth feature of the present invention, since an image forming apparatus includes the latent image carrier having its circumferential wall strengthened by the deformation preventing member, resonance readily generated by charging conditions is suppressed, whereby generation of noise can be prevented and the latent image carrier can be prevented from deforming in the axial direction as well. Accordingly, it is possible to prevent charging properties from changing by maintaining the opposing state between the charging member and the latent image carrier according to predetermined conditions. Formation of abnormal images caused by a change in the charging property can thus be prevented.

What is claimed is:

1. A latent image carrier having an electrostatic latent image corresponding to an optically formed and uniformly charged photo sensitive layer, the latent image carrier comprising:

a thin cylindrical body comprising a photosensitive outer surface for forming said latent image carrier thereon; and a deformation preventing member disposed in an interior portion of said thin cylindrical body, said deformation preventing member further comprising:

a base having a central axial axis substantially aligned with a central axial axis of said thin cylindrical body; and a plurality of leg parts axially disposed on said base and extending along a circumferential direction thereof, wherein a distal end of each one of said plurality of leg parts is elongated towards an interior surface of said latent image carrier and is provided with a bulging portion configured to coming into contact with an inside surface of said latent image carrier.

2. The latent image carrier according to claim 1, wherein said deformation preventing member is twisted in an axial direction of said latent image carrier forming successive blade structures between axial ends of said latent image carrier.

3. The latent image carrier according to claim 2, wherein said deformation preventing member is formed of an elastic body.

4. The latent image carrier according to claim 1, wherein said deformation preventing member is formed of an elastic body, and a diameter of said deformation preventing member is greater than an inner diameter of said latent image carrier.

5. The latent image carrier according to claim 1, wherein said latent image carrier is formed of a rigid body.

6. The latent image carrier according to claim 1, wherein said deformation preventing member is made of rubber.

7. An image forming apparatus comprising:

a charging device;

a cleaning device; and a latent image earner to effect an image forming process by said image forming apparatus, said latent image carrier comprising:

a thin cylindrical body comprising a photosensitive outer surface for forming said latent image carrier thereon; and a deformation preventing member disposed in an interior portion of said thin cylindrical body, said deformation preventing member further comprising:

a base having a central axial axis substantially aligned with a central axial axis of said thin cylindrical body; and a plurality of leg parts axially disposed on said base and extending along a circumferential direction thereof, wherein a distal end of each one of said plurality of leg parts is elongated towards an interior surface of said latent image carrier and is provided with a bulging portion configured to coming into contact with an inside surface of said latent image carrier.

* * * * *